United States Patent [19]

Ishikawa et al.

[11] 3,940,072

[45] Feb. 24, 1976

[54] SPRAY-EJECTING DEVICE

[75] Inventors: Yasuo Ishikawa, Yokohama; Masahiro Ito, Tokyo, both of Japan

[73] Assignee: Tokico Ltd., Kawasaki, Japan

[22] Filed: Oct. 8, 1974

[21] Appl. No.: 513,170

[30] Foreign Application Priority Data

Oct. 11, 1973 Japan ..... 48-113201

[52] U.S. Cl. ..... 239/587

[51] Int. Cl.[2] ..... B05B 15/08

[58] Field of Search ..... 239/525, 587, 575

[56] References Cited

UNITED STATES PATENTS

| | | | |
|---|---|---|---|
| 864,910 | 9/1907 | O'Neill | 239/587 |
| 2,532,447 | 12/1950 | Handoll et al. | 239/587 X |
| 2,857,201 | 10/1958 | Palmer | 239/587 X |
| 3,166,252 | 1/1965 | O'Brien et al. | 239/587 |
| 3,670,967 | 6/1972 | Fahlin et al. | 239/525 X |

FOREIGN PATENTS OR APPLICATIONS

| | | | |
|---|---|---|---|
| 641,414 | 8/1950 | United Kingdom | 239/587 |

*Primary Examiner*—Evon C. Blunk
*Assistant Examiner*—Andres Kashnikow
*Attorney, Agent, or Firm*—Haseltine, Lake & Waters

[57] ABSTRACT

A spray-ejecting device comprising a long tubular structure having passageways therewithin for conducting a spray material to be spray-ejected and having forward and rear ends, and a nozzle rotatably mounted on the forward end of the tubular structure in a manner to be supplied with the spray material thus conducted through the passageways and to be rotatable so that the direction of the centerline thereof can be adjusted relative to the centerline direction of the tubular structure. A valve control device is provided in the vicinity of the rear end of the tubular structure for controlling a valve mechanism for controlling the supply of the spray material to the nozzle, and an adjustment mechanism having an adjusting knob is provided in the vicinity of the valve control device and when the adjusting knob is manipulated, the nozzle undergoes rotational adjustment to a desired direction of the centerline thereof.

3 Claims, 3 Drawing Figures

SPRAY-EJECTING DEVICE

BACKGROUND OF THE INVENTION

This invention relates generally to a spray-ejecting device and more particularly to a spray-ejecting device provided with a spray-ejecting nozzle at the front or working end of a relatively long tube, the spray-ejecting direction of the spray-ejecting nozzle being adjustable.

Heretofore, for spray-coating paint on surfaces to be painted at positions which cannot be reached by the hand of a painting worker, there has been used a spray-coating device in which there is installed a spray-coating nozzle at the forward or working end of a relatively long, tubular body structure and a manipulative control device at the rear end of the main structure for controllably operating a shut-off valve, and this control device is held by an operator to carry out spray painting of surfaces to be painted by the spray-coating nozzle.

In this known spray-coating device, the spray-coating nozzle is adapted to be adjustable in the ejection direction in accordance with the state of the surfaces to be coated so as to make possible spray-coating irrespective of the state of these surfaces as determined by their features such as positions, shapes, and directions of inclination.

In this known spray-coating device, however, a mechanism is provided merely to afford movability of the spray-coating nozzle relative to the tubular body structure. For this reason, every time the spray-ejecting direction is to be varied, the operator must adjust the spray-ejection direction by moving the front end of the tubular body structure toward himself, grasping the nozzle by hand, for example, and turning it by a certain amount by a rough estimate with the aim of adjusting the spray-ejection in the desired direction.

Consequently, it is difficult to make an adjustment with a single manipulation so as to direct the ejection accurately in the desired direction, and such adjustment requires much time. Furthermore, every time this adjustment is to be carried out, the troublesome procedure of pulling the forward end of the tubular body structure toward the operator must be carried out, and, moreover, the spray-coating work must be temporarily stopped for this adjustment, whereby the spray-coating work efficiency drops.

SUMMARY OF THE INVENTION

Accordingly, it is a general object of the present invention to provide a novel and useful spray-ejecting device in which the above described problems have been overcome.

More specifically, an object of the invention is to provide a spray-ejecting device in which the ejection direction of a spray-ejecting nozzle provided at the forward end of a tubular body structure can be adjusted by control manipulation of a control part provided near the rear end of the body structure. By the provision of this feature of the invention, it is possible to adjust the spray-ejection of the nozzle as desired to the optimum direction while the spray-ejecting work is being carried out. Accordingly, since the spray-ejecting work need not be interrupted for the nozzle direction adjustment, the work efficiency is high. Moreover, accurate adjustment to the optimum ejecting direction can be made with a single manipulation at the rear end of the spray-ejecting device.

Another object of the invention is to provide a spray-ejecting device of the above stated character in which the ejecting direction of the nozzle provided at the forward end of the tubular body structure can be adjustably varied by the simple manipulation of merely turning an adjusting knob.

Other objects and further features of the invention will be apparent from the following detailed description with respect to a preferred embodiment of the invention when read in conjunction with the accompanying drawings.

DETAILED DESCRIPTION

Figure 1:
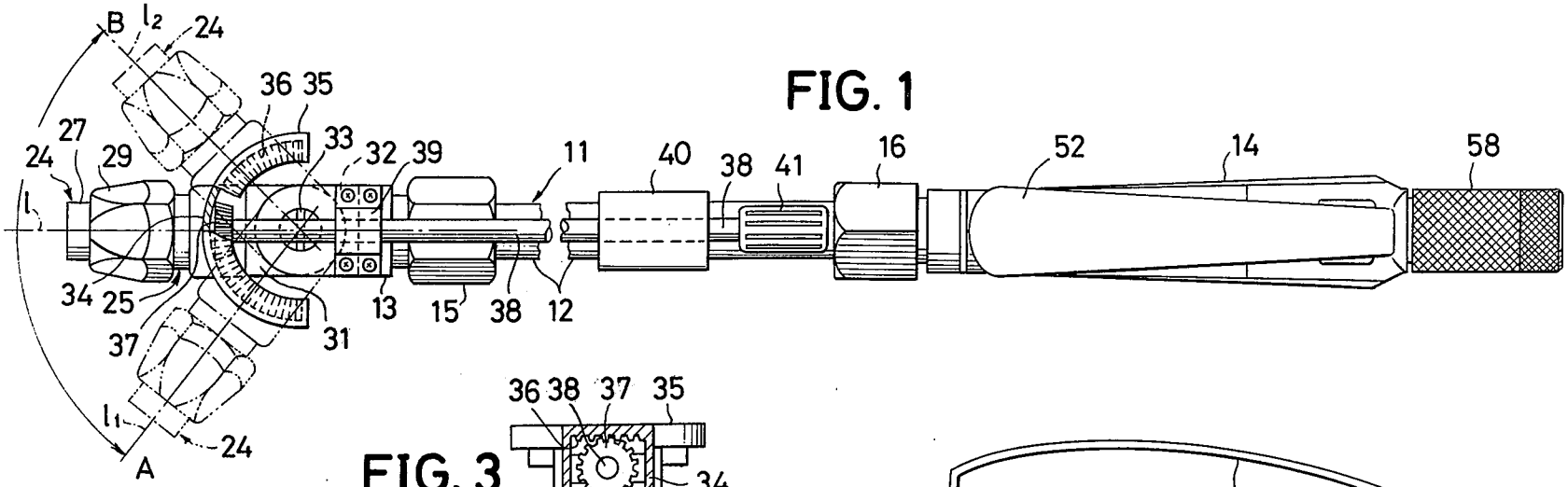
FIG. 1 is a plan view, with a part cut away, showing one embodiment of a spray-ejecting device according to the present invention.
Figure 3:
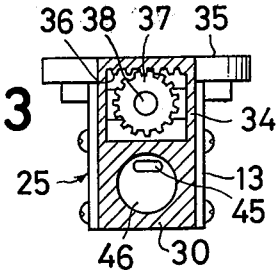
FIG. 3 is a section taken along the line III—III in FIG. 2 as viewed in the arrow direction.

Referring to the drawing, the spray-ejecting device illustrated therein has a body structure 11, which can be broadly divided into a relatively long, straight, hollow, tubular part 12, a head part 13, and a handle part 14. The head part 13 is connected to the forward end of the tubular part 12 by a coupling 15 screwed onto the rear end of the head part 13. The handle part 14 is connected at its forward end to the rear end of the tubular part 12 by a coupling 16.

The head part 13 has a passageway 18 communicating at its rear end with the forward end of the hollow interior 17 of the tubular part 12. The principal structural parts of the handle part 14 are a straight part 19 and an inclined part 20 integrally formed with the straight part 19 and extending obliquely downward and rearward. The straight part 19 and the inclined part 20 respectively have passageways 21 and 22 therewithin, the passageway 22 communicating at its forward end with the lower part of the passageway 21, which communicates at its front end with the rear end of the hollow interior 17 of the tubular part 12. The inclined part 20 is provided at its rear end with a fitting 23 for connecting one end of a hose (not shown) thereto. The other end of this hose is connected to a pump (not shown) for supplying a fluid to be spray-ejected such as a paint.

The head part 13 is provided at its forward end with a nozzle 24 comprising a nozzle body 27 having an ejection orifice 26, a filter 28, a hollow holding member 25, and a retainer 29 securing the nozzle body 27 and the filter 28 to the holding member 25. The holding member 25 comprises a hollow cylindrical member 30, a flat plate part 31 formed integrally with the cylindrical member 30 and extending rearward therefrom, and a semicircular arcuate rack part 35 provided on its lower side with rack teeth 36 and formed integrally with the cylindrical member 30 and a riser wall 34 rising upward from the cylindrical member 30 and supporting the arcuate rack part 35. The above mentioned plate part 31 is fitted rotatably in a slot 32 provided in the head part 13 and is pivotally held by a pivot pin 33 fixed to the head part 13 and is thereby swingable in the directions of arrows A and B.

The gear teeth 36 on the lower side of the arcuate rack part 35 have the shape of a planar development of a bevel gear. These gear teeth 36 are meshed with a bevel gear 37 fixed to the forward end of a rotatable shaft 38 extending rearward and substantially parallel to the tubular part 12. This shaft 38 is provided at its rear end with a knob 41 in the vicinity of the handle part 14. The shaft 38 is supported by bearings 39 and 40 respectively fixed to the head part 13 and the tubular part 12 in such a manner that the shaft 38 is rotatable about the centerline thereof and is parallel to the centerline of the part 12.

The plate part 31 is subjected to the force of a spring 43 acting by way of a washer 42 and is thereby pressed against the upper wall surface of the slot 32, whereby rattling of the plate part 31 relative to the head part 13 due to play therebetween is prevented. The washer 42 has a through-hole 44 communicating with the passageway 18. The plate part 31 has a hole 45 communicating with an internal space 46 in the holding member 25.

A valve seat 48 of a needle valve mechanism 47 is provided at the connection between the forward end of the tubular part 12 and the rear part of the head part 13. At its center, this valve seat 48 has a hole 50 communicating with the passageway 18. The needle valve mechanism 47 is further provided with a slidable valve stem 49 disposed within the tubular part 12 and supported in a manner permitting its sliding movements in the forward and rearward directions C and D. The valve stem 49 has at its forward end a valve body 51 of semispherical shape for cooperative operation with the valve seat 48. When the valve stem 49 is displaced in the rearward direction D, the valve body 51 separates from the valve seat 48, whereupon the hollow interior 17 of the tubular part 12 becomes communicative with the passageway 18. On the other hand, when the valve stem 49 is displaced in the forward direction C, the valve body 51 abuts against the valve seat 48 and is thus seated to shut off communication between the hollow interior 17 and the passageway 18.

Figure 2:
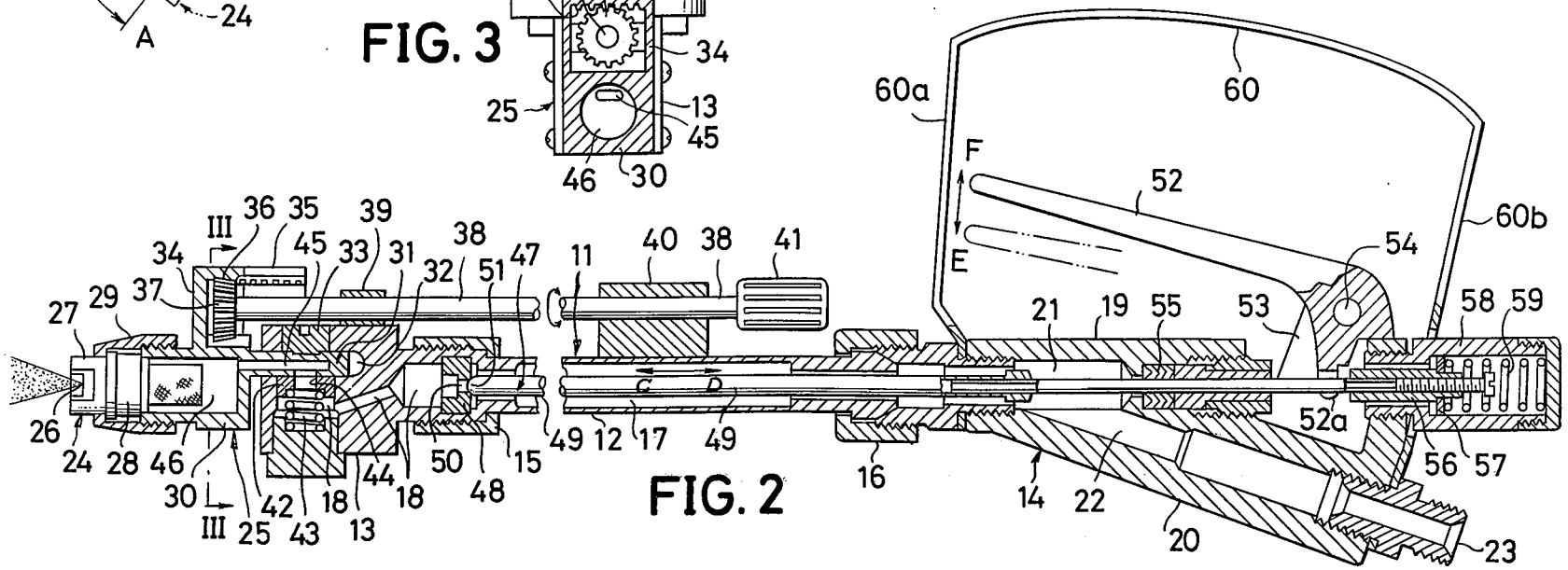
FIG. 2 is a side view, in longitudinal section, of the same spray-ejecting device.

The rear part of the valve stem 49 extends rearward through the passageway 21 of the straight part 19 of the handle part 14 and further rearward to the outside through a fluid-tight seal 55 provided at the rear end of the straight part 19. The rear end of the valve stem 49 is threadably connected to a sleeve 56 having a stepped shoulder part against which a washer 57 is engaged. A compression spring 59 is provided between the rear face of this washer 57 and the rear wall of an adjusting member 58 of cylindrical shape enclosing the spring 59 and the rear end part of the valve stem 49. The spring 59 applies a force by way of the sleeve 56 to the valve stem 49, urging it to move in the forward direction C, and in the state illustrated in FIG. 2, the valve body 51 is seated against the valve seat 48. The adjusting member 58 at its front end is screwed into the rear part of a support flange 53. By turning this adjusting member 58, its forward-and-rearward position relative to the flange 53 is varied, and the force of the spring 59 acting on the valve stem 49 can thereby be adjusted.

A lever 52 is pivotally connected by a pivot pin 54 to the support flange 53 projecting from and formed integrally with the inclined part 20 of the handle part 14 and is rotatable in the counterclockwise and clockwise directions E and F. The lever 52 is prevented by a guard structure 60 from being contacted by another object and being rotated unnecessarily or accidently in the counterclockwise direction E. The ends of the front and rear legs **60*a* and 60*b* of this guard structure 60 are respectively fixed to the forward end of the straight part 19 and to the rear end of the inclined part 20 of the handle part 14. The lever 52 has a short arm with an engagement part 52*a* and its outer end for engagement with the sleeve 56** as described hereinafter.

The spray-ejecting device of the above described construction according to the present invention operates as follows.

When spray ejection is not being carried out, the lever 52 is in the outermost position of its rotation in the clockwise direction F, and the valve stem 49 is at the most forward position of its sliding stroke in the arrow direction C as a result of the force of the spring 59. Accordingly, the valve 51 is seated against the valve seat 48, whereby the needle valve mechanism 47 is in its closed state.

When a spray fluid is to be sprayed, the lever 52 is squeezed by hand and thus rotated in the direction E. As a consequence, the engagement part **52*a* of the lever 52 engages the sleeve 56 and forces the sleeve 56 and the valve stem 49 in the rearward direction D against the force of the spring 59. As a result of this sliding movement of the valve stem 49, the valve 51 separates from the valve seat 48, whereupon the hollow interior 17 of the tubular part 12 and the passageway 18** become communicative.

Consequently, the spray fluid sent under pressure from the aforementioned pump through the supply hose flows through the hose connection fitting 23, the passageways 22 and 21 of the handle part 14, the hollow interior 17 of the tubular part 12, the hole 50 of the valve seat 48, the passageway 18 of the head part 13, the through-hole 44 of the washer 42, the hole 45 of the plate part 31, the interior space 46 within the holding member 25, and the filter 28 and is ejected as a spray through the orifice 26 of the nozzle 24. When the lever 52 is released, the valve stem 49 is returned in the forward direction C by the force of the spring 59, whereby the needle valve mechanism 47 is closed. At the same time, the sleeve 56 presses the engagement part **52*a* of the lever 52 forward, whereby the lever 52** is returned clockwise in the direction F.

Then, in the case where the movement of the long body structure 11 of the spray-ejecting device is restricted for some reason, or in the case where spray-ejecting is to be applied to a surface, such as a surface with complicated convexities and concavities or a hidden surface, which cannot be easily sprayed even when the body structure 11 is moved, it becomes necessary to change the ejection direction of the nozzle 24. This changing of the ejection direction can be accomplished without interrupting the above described spraying operation by gripping with one hand the handle part 14 and the lever 52 rotated in the counterclockwise direction E and turning the knob 41 with the other hand.

As a result of the turning of the knob 41 the rotatable shaft 38 and, therefore, the bevel gear 37 are rotated. Since the shaft 38 is rotatably supported by the bearings 39 and 40 but is prevented thereby from being displaced in translational movement, the bevel gear 37 rotates in the same position. As a result of this rotation of the bevel gear 37, the arcuate rack part 35, which is provided integrally with the holding member 25 together with the plate part 31, and whose teeth 36 are meshed with the bevel gear 37, is rotated about the axis of the pin 33 in a direction determined by the rotational direction of the bevel gear 37. Consequently, the holding member 25 rotates unitarily with the rack part 35.

Together with the rotation of the rack part 35, the nozzle 24 held by the holding member 25 also swings unitarily in the direction A or B, and the direction of the axis of the nozzle 24, i.e., the ejection direction, *l* is suitably adjustable within a range as indicated by lines *l*1 and *l*2. When the ejection direction *l* has been adjusted in the desired direction, the knob 41 is released, whereupon the nozzle 24 is held in its adjusted rotational direction.

Thus, it is possible to carry out adjustment by remote control of the ejection direction of the nozzle 24, while the lever 52 is being squeezed in the counterclockwise direction E to continue spraying, by turning the knob 41 provided remotely from the nozzle 24 and near the lever 52. Accordingly, the necessity of resorting to the troublesome procedure of temporarily interrupting the spraying work, pulling the nozzle 24 toward oneself, and adjusting the nozzle ejection direction is eliminated. Furthermore, the nozzle ejection path can be easily adjusted to the optimum direction since this adjustment can be accomplished while the spraying work is being carried out.

It should be understood, of course, that the material to be sprayed by the spray-ejecting device according to the present invention is not limited to paints or to liquids but may be a gas or a solid in particulate form.

Further, this invention is not limited to these embodiments but various variations and modifications may be made without departing from the scope and spirit of the invention.

What is claimed is:

1. A spray-ejecting device comprising:

an elongated tubular structure of a hand supporting type having passageways therein for passing therethrough a spray material to be spray-ejected and having a forward end and a rear end; a nozzle rotatably mounted on the forward end of the tubular structure in a manner to communicate with the passageways in the tubular structure and to be rotatable so that the direction of the centerline thereof is angularly adjustable relative to the centerline of the tubular structure, said nozzle being operable to spray-eject said spray material;

a valve mechanism for selectively shutting off and permitting supply of said spray material through the passageways of the tubular structure to the nozzle;

valve control means mounted in the vicinity of the rear end of the tubular structure for controlling the operation of the valve mechanism; and adjustment means for rotating the nozzle relative to the tubular structure thereby to adjust the direction of spray-ejection from the nozzle, said adjustment means comprising a rotatable knob in the vicinity of the valve control means, a rotatable shaft having front and rear ends, said knob being fixed to the rear end of said rotatable shaft, said shaft extending forwardly from said knob substantially parallel to the tubular structure to a position in the vicinity of said nozzle, and rotating means coupled to the forward end of said rotatable shaft for displacing the nozzle in rotation thereby to adjust the direction of spray-ejection from the nozzle in accordance with the rotation of the rotatable shaft, said rotating means comprising a bevel gear fixedly mounted on the forward end of the rotatable shaft, a holding member unitarily holding the nozzle and pivotally supported by the tubular structure, and a rack part integrally mounted on the holding member and having a planar arcuate shape and a toothed face corresponding to a planar development of a bevel gear in mesh with said first mentioned bevel gear.

2. A spray-ejecting device as claimed in claim 1 in which the tubular structure comprises an elongated tubular part having said passageways therein, and a head part connected to the forward end of the tubular part, said head part rotatably supporting said holding member and having a passageway communicable with the passageways within said tubular part and with said nozzle.

3. A spray-ejecting device as claimed in claim 2 in which the valve mechanism comprises a valve seat within the head part and encircling the passageway within the head part at one section thereof and a slidable valve stem extending through the passageways within the tubular part and actuated in longitudinal sliding motion by controlling action of the valve control means to cause a valve formed at the forward end of the valve stem to separate from and seat on the valve seat thereby to permit and shut off supply of the spray material to the nozzle from the passageways in the elongated tubular part.

* * * * *